United States Patent [19]

van den Bemt

[11] 4,436,508

[45] Mar. 13, 1984

[54] CERAMIC BURNER FOR GAS, PARTICULARLY FOR A HOT-BLAST STOVE FOR A BLAST FURNACE

[75] Inventor: Johannes C. van den Bemt, Schagen, Netherlands

[73] Assignee: Estel Hoogovens BV, Netherlands

[21] Appl. No.: 366,135

[22] Filed: Apr. 6, 1982

[51] Int. Cl.[3] ..... C21B 9/00; F24H 7/00; F23C 5/00

[52] U.S. Cl. ..... 432/214; 431/174

[58] Field of Search ..... 432/214, 216, 217, 218, 432/30; 431/7, 170, 174

[56] References Cited

U.S. PATENT DOCUMENTS

| | | | |
|---|---|---|---|
| 3,837,793 | 9/1974 | Lucieer et al. | 432/217 |
| 3,901,445 | 8/1975 | Chang . | |
| 4,313,724 | 2/1982 | Muller et al. | 431/170 |

FOREIGN PATENT DOCUMENTS

| | | |
|---|---|---|
| 15162 | 9/1980 | European Pat. Off. . |
| 500699 | 6/1930 | Fed. Rep. of Germany . |
| 2903147 | 5/1980 | Fed. Rep. of Germany . |
| 1451036 | 10/1965 | France . |

*Primary Examiner*—John J. Camby
*Attorney, Agent, or Firm*—Stevens, Davis, Miller & Mosher

[57] ABSTRACT

A ceramic burner for gas, for a combustion chamber of a hot-blast stove of a blast furnace, has parallel vertical supply ducts for the two combustion components (gas and air). A first one of said ducts opens upwardly at a first outlet which is substantially oblong in plan view and the second of said ducts opens at a plurality of second outlets which are located on either side of and above the first outlet, the general discharge directions of the second outlets being oblique to that of the first outlet. In order to provide improvement in the mixing and homogenisation of the combustion components, the first outlet has, as seen in plan view, a slot shape and has, it its long sides, a plurality of recesses which extend outwardly towards the second outlets. The second outlets are arranged alongside the said long sides of the first outlet with the second outlets on one side opposite those on the other side. The recesses are, along the length of the first outlet, located alternately in said long sides and, on each said long side, directed towards alternate ones of said second outlets.

7 Claims, 3 Drawing Figures

CERAMIC BURNER FOR GAS, PARTICULARLY FOR A HOT-BLAST STOVE FOR A BLAST FURNACE

BACKGROUND OF THE INVENTION

1. Field of the Invention

This invention relates to a ceramic burner, particularly such a burner for a hot-blast stove of a blast furnace. The invention also relates to a hot-blast stove having such a ceramic burner.

2. Description of the Prior Art

A ceramic burner of a hot blast stove is located in the combustion shaft of the stove. German patent specification No. 1,803,984 illustrates a ceramic burner having parallel vertical supply ducts for the two components of combustion, namely combustion gas and combustion air, wherein a first supply duct opens upwardly at a substantially oblong first outlet and the second supply duct opens at second outlets arranged in two sets above and on either side of the first outlet, the discharge directions of the second outlets being oblique to that of the first outlet.

In burners for hot blast stoves, it is of major importance that scarcely any combustible components of the combustion gas should be left unburned. To avoid nuisance to the environment, strict limitations are imposed in this respect by the authorities in various countries. On the other hand, it is also important that the surplus of air for combustion should be kept as low as possible, in order to achieve the highest possible temperature of the gaseous combustion products. To achieve both these aims, it is necessary for the combustion components to be thoroughly and uniformly mixed together as they leave the openings of the burner.

The above-mentioned German specification describes a burner in which the first outlet has a wholly rectangular shape, and the first set of second outlets are located at a distance from those of the second set. This causes the combustion ingredients discharged from the various outlets to flow through and alongside one another, as a result of which they become mixed together. It now appears that this mixing can be further improved.

SUMMARY OF THE INVENTION

It is the object of the present invention to provide a burner which improves this mixing action and the homogenisation of the gas/air mixture, so as to achieve a more complete combustion of the combustion gas.

According to the invention, the first outlet has a slot shape and has, in its long sides recesses located opposite alternate ones of said second outlets on each side, the second outlets on one side being respectively opposite those on the other side. This arrangement produces an entirely different flow pattern from that of the design shown in German specification No. 1,803,984. The flow-streams of the combustion component from the two sets of second outlets are no longer directed alongside one another, causing them to penetrate the flow-stream of combustion component being discharged from the first outlet; instead combustion component from the second outlets is now directed towards and along the flow-stream of the combustion component from the first outlet. This is because the outlets of the two sets are not located at a distance from one another. Thorough mixing and homogenisation is achieved through the presence of the recesses in the slot shape of the first outlet. These recesses cause intensive turbulence around the long sides of the first outlet, resulting in a rapid and effective mixing and homogenisation of the various currents of gas. The mixing action in this instance is therefore achieved not so much by spraying various gas jets across one another, but by directing thin strata of gas towards one another instead and causing them to diffuse at an accelerated rate on account of increased turbulence.

This appears to produce a more settled flame pattern with more complete combustion of the combustion gas than has so far been possible using burners known hitherto.

A further improvement in the formation of mixing turbulence may be achieved if the second outlets located between the above-mentioned alternate ones of said second outlets lie in planes extending outwards and upwards obliquely away from the first outlet, the recesses in the first outlet being formed by rectangular-section grooves which extend upwardly to the first outlet in the side walls of the first duct, said grooves extending obliquely parallel to said planes from said first outlet so as to intersect the respective said alternate ones of said second outlets. In many cases, the known ceramic burners are constructed of several separate refractory elements. In order to keep down the costs of the apparatus, it is generally attempted to construct the burner where possible from refractory elements which differ as little as possible in shape. It has been found that this may be achieved very effectively when the recesses are provided by grooves in this manner.

The shape of the flame, its stability, and the completeness of combustion of the combustion gas are influenced among other things by the location of these oblique planes and the directions in which the combustion components are discharged in relation to one another. Good results may be achieved if the oblique planes are inclined at an angle $\beta$ of 15° to 45° relative to the vertical and wherein the discharge directions of the second outlets are inclined at an angle $\alpha$ of 30° to 70° to this vertical direction. Preferred values are 35° to 40° for angle $\alpha$, and 25° to 30° for angle $\beta$.

It has appeared that a relatively simple and effective construction may be achieved if the recesses are square in shape as seen in plan view with a side length equal to 25 to 40% of the width of the slot-shape of the first outlet.

BRIEF DESCRIPTION OF THE DRAWINGS

The preferred embodiment of the invention will now be described by way of non-limitative example with reference to the accompanying drawings, in which.

DESCRIPTION OF THE PREFERRED EMBODIMENT

Figure 1:
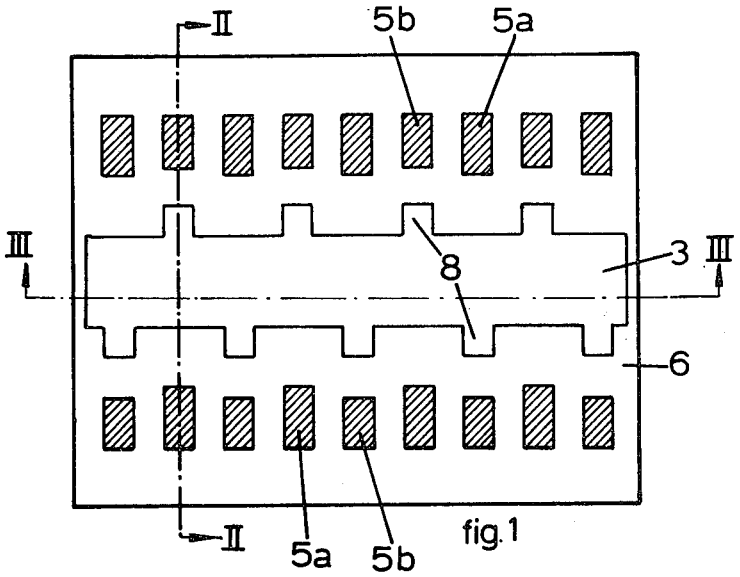
FIG. 1 illustrates, in plan view, the tip of a ceramic burner in accordance with the invention.

The installation and use of the illustrated ceramic burner of the invention in the combustion shaft of a hot-blast stove are completely in accordance with the state of the art, as described for example in German patent specification No. 1,803,984. Further description and explanation about this is therefore superfluous.

Combustion gas is supplied through a central duct 1 in the burner tip 6 and discharged at a first outlet 3 into a combustion shaft of a hot-blast stove. The outlet 3 has an elongate slot-shape, as seen in plan view. Two boundary surfaces 10 (see FIG. 2) of the burner tip extend outwards and upwards at an angle from the outlet 3 to connect with the wall 11 of a combustion shaft which is partly shown in FIG. 2 but not in FIG. 1. The surfaces 10 are inclined at an angle $\beta$ of 30° to the vertical.

Figure 2:
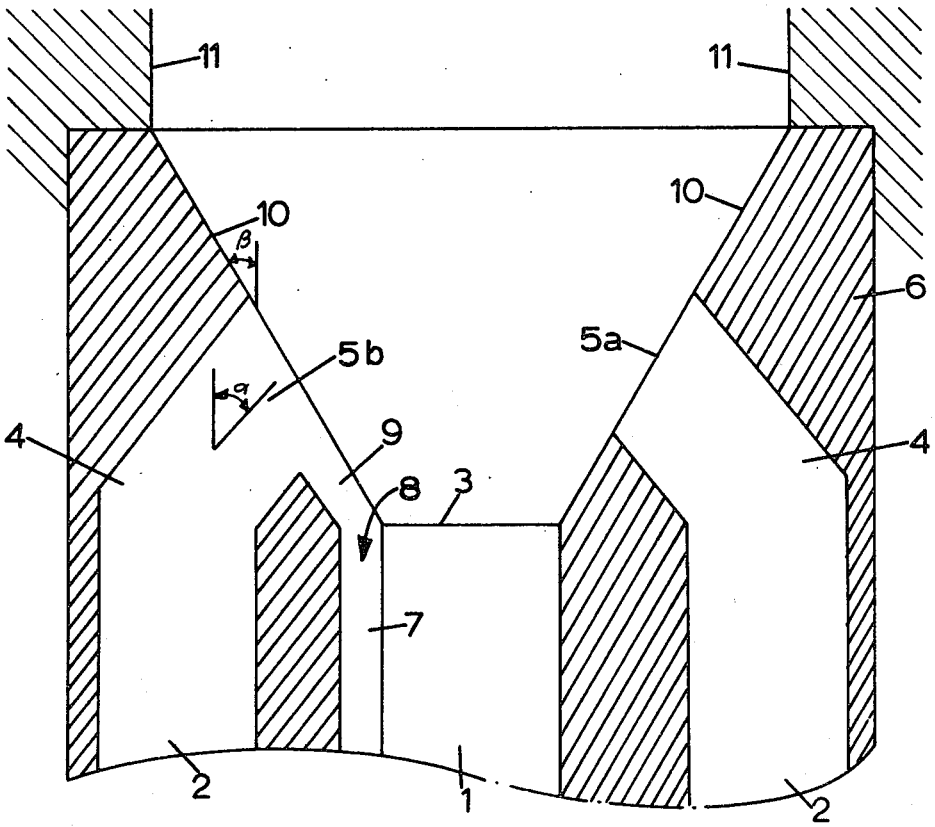
FIG. 2 is a cross section along the line II—II in FIG. 1 on an enlarged scale.

On each side of the supply duct 1, there is an air supply duct 2 which discharges via an obliquely extending duct-section 4 into second outlets 5*a* and 5*b*. These second outlets are in two sets, one on each side of the first outlet 3. Each set has outlets 5*a* alternating with outlets 5*b* as explained further below. The discharge angle of these duct sections 4 through the outlets 5*a* and 5*b* is indicated in FIG. 2 as $\alpha$, wherein $\alpha$ is 36°. The outlets 5*a* are at the level of the planes 10.

The long side walls of the supply duct 1 has grooves 7 of a square cross section which continue as similarly shaped grooves 9 on reaching the surface of the burner tip 6. The grooves 9 open into the duct sections 4 at the outlets 5*b*. This effectively results in the outlets 5*b* being set back from the outlets 5*a* by an amount equal to the depth of the grooves. Outlets 5*a* and 5*b* alternate with each other within each set of outlets and furthermore occupy alternate positions in one set of outlets relative to the other. The grooves 7 form a square recess, as seen in FIG. 1, in the outlet 3 at the point where this outlet 3 discharges from supply duct 1. As FIG. 1 shows, these recesses alternate from one side of the outlet 3 to the other, in the longitudinal direction of the outlet 3.

Figure 3:
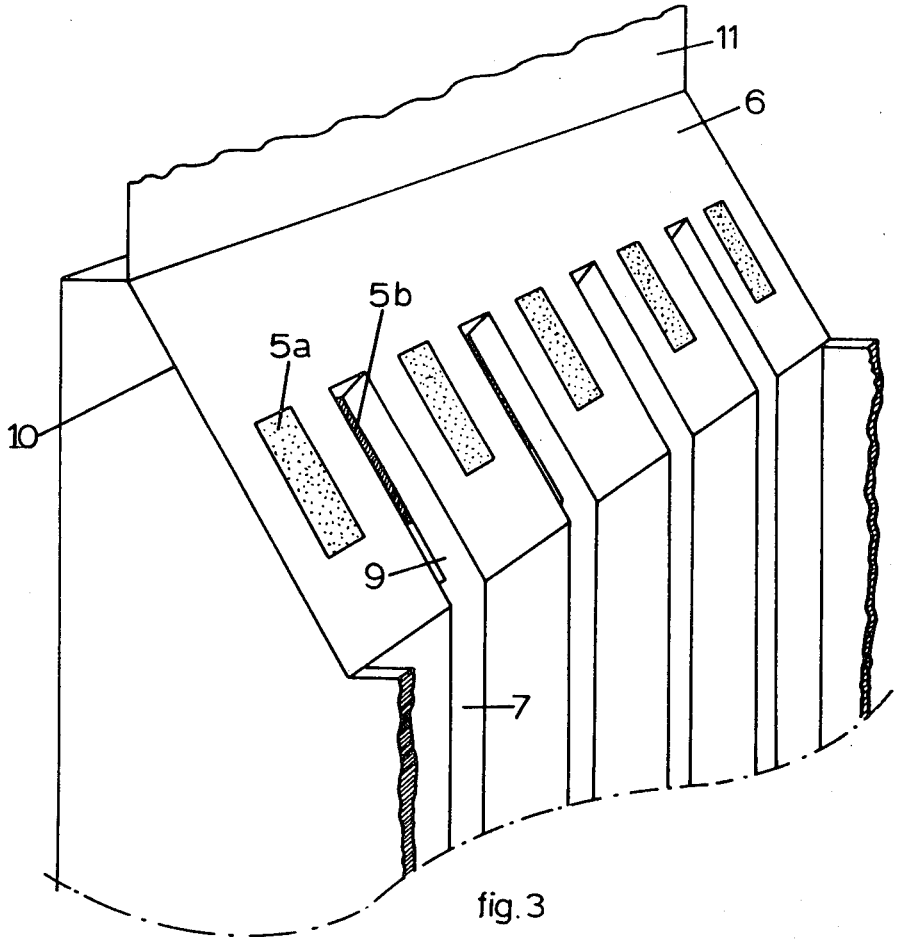
FIG. 3 shows one side of the burner viewed in perspective along the line III—III in FIG. 1.

FIG. 3 illustrates the side of the burner in perspective, from which the course of the grooves 7 and 9 and the recessed position of outlets 5*b* relative to outlets 5*a* are clearly visible.

FIG. 1 illustrates how outlets 5*a* and 5*b* of one set on one side of outlet 3 are each arranged in the same plane (i.e. directly opposite) as an outlet 5*a* or 5*b* from the other set on the other side of outlet 3. Air for combustion discharged from these sets of outlets 5*a* and 5*b* does not therefore flow through the central gas current but towards and along it. The particular design of the recesses 8 and the effectively recessed position of outlets 5*b*, as indicated in the drawings, give rise to an exceptionally turbulent transition layer between the currents of gas and air, as a result of which more or less ideal homogenisation of gas and air is achieved over a very short distance. This results in a stable flame shape and highly uniform and complete combustion of the combustion gas without too large an excess of combustion air.

What is claimed is:

1. In a ceramic burner for use in combustion gas in a combustion chamber of a hot blast stove for a blast furnace plant having a burner tip defining a vertical gas conduit and vertical air conduits on the sides of the gas conduit exiting through ports into the gas conduit, the improvement comprising the tip defining a gas conduit of rectangular cross-section in plan view having portions of the longer sides flared outwardly at an exit end, said ports exiting in said flared portions, a plurality of spaced vertical recesses of lesser number than said ports on each longer side of said gas conduit and staggered with respect to the recesses on the other side, said recesses extending along said gas conduit in the flared portions to alternating ports of said air conduits.

2. The burner according to claim 1, wherein said recesses are formed by rectangular-sectioned grooves.

3. The burner according to claim 2 wherein said flared portions are each at an angle ($\beta$) in the range 15° to 45° to the vertical and the discharge directions of the ports of said air conduits are each at an angle ($\alpha$) in the range 30° to 70° to the vertical.

4. The burner according to claim 3 wherein $35° < \alpha < 40°$ and $25° < \beta < 30°$.

5. The burner according to claim 1, 2 or 3, wherein said recesses are square in shape as seen in plan view and have a depth which is equal to 20 to 30% of the width of the gas conduit.

6. A ceramic burner for use in combusting gas in a combustion chamber of a hot blast stove for a blast furnace plant comprising a burner tip, said tip defining a vertical gas conduit of rectangular cross-section in plan view having portions of the longer sides of the conduit flared outwardly at an exit end, vertical air conduits adjacent each of the longer sides of said gas conduit in plan view exiting through ports in the flared portions, said tip defining a plurality of spaced vertical recesses of lesser number than said ports on each longer side of said gas conduit and staggered with respect to the recesses of the other side, said recesses extending along the flared portions to alternating ports of the air conduits.

7. A hot-blast stove of a blast furnace, having a ceramic burner according to claim 1, 2 or 6.

* * * * *